US011145457B2

(12) United States Patent
Choi et al.

(10) Patent No.: US 11,145,457 B2
(45) Date of Patent: Oct. 12, 2021

(54) COIL COMPONENT AND METHOD FOR MANUFACTURING THE SAME

(71) Applicant: SAMSUNG ELECTRO-MECHANICS CO., LTD., Suwon-si (KR)

(72) Inventors: Young Do Choi, Suwon-si (KR); Yu Jong Kim, Suwon-si (KR); Sung Min Moon, Suwon-si (KR); Tae Ryung Hu, Suwon-si (KR); Sang Seob Kim, Suwon-si (KR); Dong Min Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 295 days.

(21) Appl. No.: 16/216,754

(22) Filed: Dec. 11, 2018

(65) Prior Publication Data

US 2019/0304680 A1 Oct. 3, 2019

(30) Foreign Application Priority Data

Apr. 2, 2018 (KR) ..... 10-2018-0037995

(51) Int. Cl.

| | |
|---|---|
| ***H01F 27/32*** | (2006.01) |
| ***H01F 41/06*** | (2016.01) |
| ***H01F 5/06*** | (2006.01) |
| ***H01F 5/04*** | (2006.01) |

(52) U.S. Cl.

CPC ..... *H01F 41/06* (2013.01); *H01F 5/04* (2013.01); *H01F 5/06* (2013.01)

(58) Field of Classification Search

CPC ... H01F 41/06; H01F 5/06; H01F 5/04; H01F 27/325; H01F 27/323; H01F 17/04; H01F 2017/048; H01F 17/0013; H01F 27/30; H01F 41/041; H01F 27/306;

(Continued)

(56) References Cited

U.S. PATENT DOCUMENTS 4,684,438 A * 8/1987 Lazzari ..... G11B 5/17 216/100
6,246,541 B1 * 6/2001 Furuichi ..... G11B 5/3116 360/123.41

(Continued)

FOREIGN PATENT DOCUMENTS

CN 102969304 A 3/2013
CN 105321676 A 2/2016

(Continued)

OTHER PUBLICATIONS

Office Action issued in corresponding Korean Application No. 10-2018-0037995, dated Apr. 19, 2019.

(Continued)

*Primary Examiner* — Mang Tin Bik Lian
(74) *Attorney, Agent, or Firm* — Morgan, Lewis & Bockius LLP

(57) ABSTRACT

A coil component includes a body in which a coil part is embedded. The coil part includes a support member having trenches, pattern walls extending from the trenches in the support member, and coil patterns extending between the pattern walls on the support member.

20 Claims, 7 Drawing Sheets

II-II'

(58) Field of Classification Search
CPC .. H01F 27/022; H01F 27/2804; H01F 27/292; H01F 27/324
See application file for complete search history.

(56) References Cited

U.S. PATENT DOCUMENTS

| | | | | |
|---|---|---|---|---|
| 6,452,742 | B1 * | 9/2002 | Crue | G11B 5/313 360/123.31 |
| 2010/0052839 | A1 | 3/2010 | Mertens et al. | |
| 2015/0294789 | A1 | 10/2015 | Sano et al. | |
| 2015/0380152 | A1 * | 12/2015 | Itoh | H01F 41/041 336/200 |
| 2016/0005527 | A1 | 1/2016 | Park et al. | |
| 2016/0155556 | A1 * | 6/2016 | Ohkubo | H01F 27/292 336/83 |
| 2016/0351316 | A1 * | 12/2016 | Ohkubo | H01F 27/325 |
| 2017/0032882 | A1 * | 2/2017 | Yang | H01F 41/042 |
| 2017/0062121 | A1 * | 3/2017 | Yang | H01F 17/0013 |
| 2017/0178790 | A1 | 6/2017 | Kim et al. | |

FOREIGN PATENT DOCUMENTS

| | | | |
|---|---|---|---|
| JP | 2016-009827 | A | 1/2016 |
| JP | 2017-017139 | A | 1/2017 |
| KR | 10-1995-0009893 | A | 4/1995 |
| KR | 10-2004-0100945 | A | 12/2004 |
| KR | 10-20150079935 | A | 7/2015 |
| KR | 10-2017-0073159 | A | 6/2017 |
| KR | 10-2017-0097864 | A | 8/2017 |

OTHER PUBLICATIONS

Office Action issued in corresponding Chinese Patent Application No. 201910236761.X, dated Jan. 6, 2021 (with English Translation).

* cited by examiner

II-II'

COIL COMPONENT AND METHOD FOR MANUFACTURING THE SAME

CROSS-REFERENCE TO RELATED APPLICATION(S)

This application claims benefit of priority to Korean Patent Application No. 10-2018-0037995 filed on Apr. 2, 2018 in the Korean Intellectual Property Office, the disclosure of which is incorporated herein by reference in its entirety.

TECHNICAL FIELD

The present disclosure relates to a coil component and a method for manufacturing the same.

BACKGROUND

In accordance with the miniaturization and thinning of electronic devices such as a digital television (TV), a mobile phone, a notebook computer, and the like, the miniaturization and thinning of coil components used in these electronic devices have been demanded. In order to satisfy such demand, various types of coil components have been developed.

One of the main issues regarding the miniaturization and thinning of coil components is to maintain the number of winding of coils and a cross-sectional area of a coil pattern, and to implement characteristics equal to characteristics of an existing coil component in spite of such miniaturization and the thinning of the coil component. In order to satisfy such a demand, a pattern wall technology capable of increasing an aspect ratio of the coil pattern while significantly reducing electrical over stress (EOS) generated when an interval between the coil patterns becomes narrower has been researched.

SUMMARY

An aspect of the present disclosure may provide a coil component capable of securing stable characteristics by using pattern walls having anchors formed in trenches in a support member.

According to an aspect of the present disclosure, a coil component may include a body in which a coil part is embedded. The coil part may include a support member; pattern walls formed on the support member, and coil patterns extending between the pattern walls on the support member and forming a plurality of windings, and the pattern walls may include a support portion having a width greater than an average width of the pattern walls.

According to an aspect of the present disclosure, a coil component may include a body in which a coil part is embedded. The coil part may include a support member having trenches, pattern walls extending from the trenches in the support member, and coil patterns extending between the pattern walls on the support member.

According to another aspect of the present disclosure, a method for manufacturing a coil component including a body in which a coil part is embedded may forming a plating seed layer on one surface of a support member, forming trenches in the support member, forming pattern walls extending from the trenches, and forming coil patterns extending between the pattern walls on the support member by using a plating seed left after etching the plating seed layer.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Figure 1:
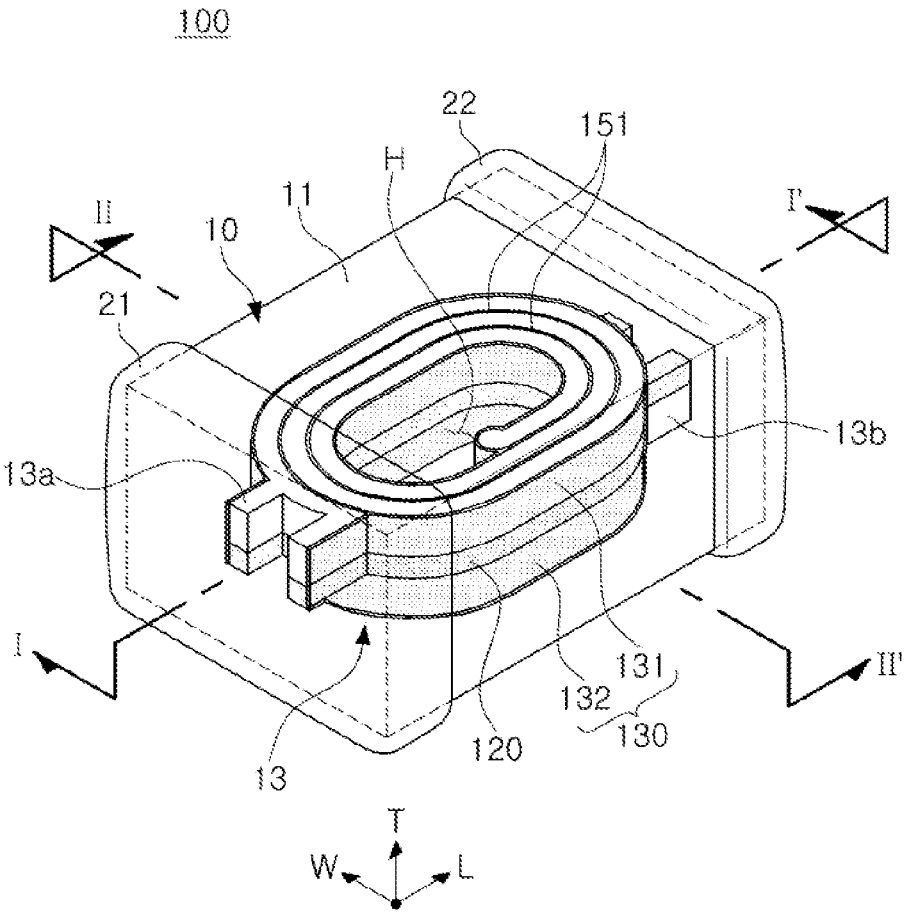
FIG. 1 is a schematic perspective view illustrating a coil component according to an exemplary embodiment in the present disclosure.
Figure 2:
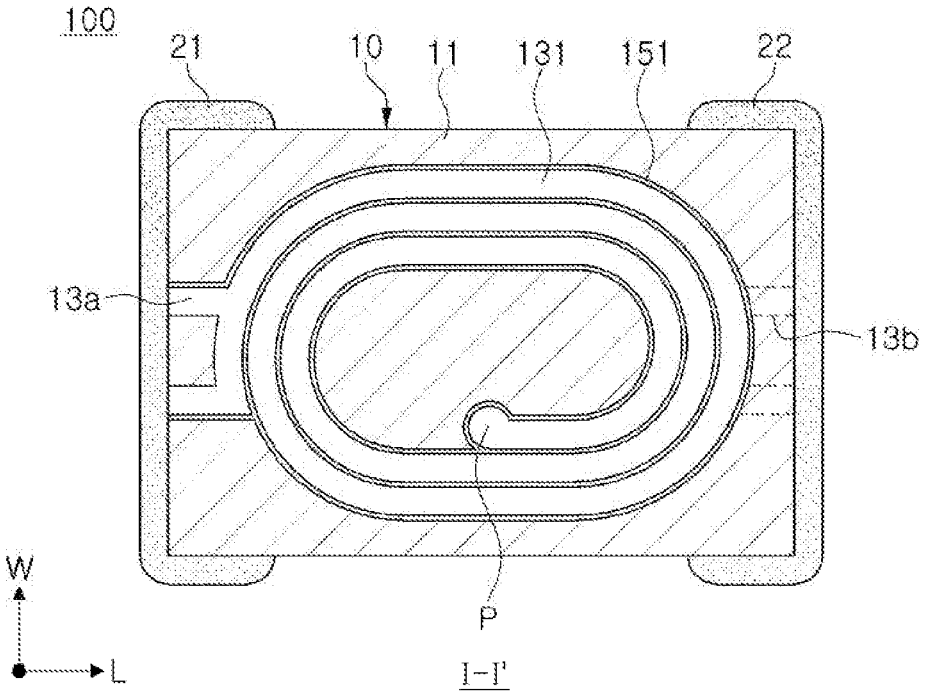
FIG. 2 illustrates a cross-sectional view taken along line I-I' of the coil component of FIG. 1.
Figure 3:
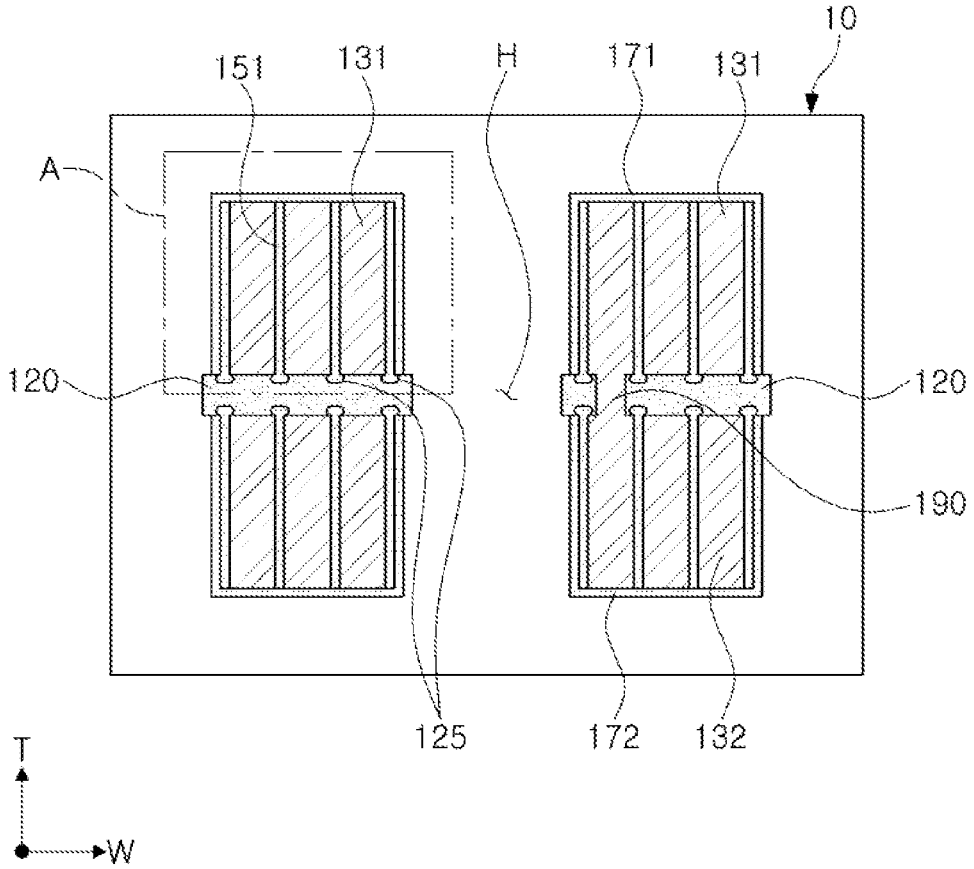
FIG. 3 illustrates a cross-sectional view taken along line II-II' of the coil component of FIG. 1.

FIG. 1 is a schematic perspective view illustrating a coil component according to an exemplary embodiment in the present disclosure, FIG. 2 illustrates a cross-sectional view taken along line I-I' of the coil component of FIG. 1, and FIG. 3 illustrates a cross-sectional view taken along line II-II' of the coil component of FIG. 1.

Referring to FIGS. 1 through 3, a coil component 100 according to an exemplary embodiment in the present disclosure may include a body 10, a coil part 13, and first and second external electrodes 21 and 22. In addition, the coil part 13 may include a coil pattern 130, pattern walls 151, and a support member 120 supporting the coil pattern 130.

The body 10 may form an overall exterior of the coil component, and may include an upper surface and a lower surface opposing each other in a thickness direction (T), a first end surface and a second end surface opposing each other in a length direction (L), and a first side surface and a second side surface opposing each other in a width direction (W) to thus have substantially a hexahedral shape, but is not limited thereto.

The first and second external electrodes 21 and 22 may be disposed on outer surfaces of the body 10. The first and second external electrodes 21 and 22 are represented in a "C" shape in a cross-section cut along a length-width plane or a length-thickness plane. The first and second external electrodes 21 and 22 may be electrically connected to the coil part 13 embedded in the body 10, and a shape of each of the first and second external electrodes 21 and 22 is not limited to a "C" shape. In addition, the first and second external electrodes 21 and 22 may be formed of a conductive material. Specifically, the first external electrode 21 may be connected to a first leading part 13*a* of one end portion of the coil part 13, and the second external electrode 22 may be connected to a second leading part 13*b* of the other end portion of the coil part 13. Therefore, the first and second external electrodes 21 and 22 may electrically connect both ends of the coil part 13 to an external electrical component (e.g., a pad of a substrate).

The body 10 may include a magnetic material 11, and may be formed of, for example, a ferrite or a metal based soft magnetic material. The ferrite may include a ferrite known in the art, such as an Mn—Zn based ferrite, an Ni—Zn based ferrite, an Ni—Zn—Cu based ferrite, an Mn—Mg based ferrite, a Ba based ferrite, an Li based ferrite, or the like. In addition, the metal based soft magnetic material may be an alloy including one or more selected from the group consisting of iron (Fe), silicon (Si), chromium (Cr), aluminum (Al), and nickel (Ni). For example, the metal based soft magnetic material may include Fe—Si—B—Cr based amorphous metal particles, but is not limited thereto. The metal based soft magnetic material may have a particle diameter of 0.1 or more and 20 μm or less, and may be included in a polymer such as an epoxy resin, polyimide, or the like, in a form in which it is dispersed on the polymer.

The coil part 13 may be encapsulated to the body 10 by the magnetic material 11. In addition, the coil part 13 may include a support member 120 and a coil pattern 130.

As illustrated in FIGS. 1 and 3, the coil pattern 130 may include first and second coil patterns 131 and 132 disposed on opposite surfaces of the support member 120 opposing each other. That is, the first coil pattern 131 may be formed on one surface of the support member 120, and the second coil pattern 132 may be formed on the other surface of the support member 120 opposing one surface of the support member 120.

The support member 120 may serve to support the coil pattern 130 and may also serve to easily form an internal coil. The support member 120 may be suitably used as long as it has insulating properties and a thin film shape. For example, an insulating film such as a copper clad laminate (CCL) substrate or an Ajinomoto Build-up Film (ABF) may be utilized. A thickness of the support member 120 may be thin in order to meet a trend of miniaturized electronic components, but since the thickness is required to such an extent that the coil pattern 130 may be properly supported, the support member 120 may have a thickness of, for example, about 60 μm. In addition, a through-hole H may be formed in the center of the support member 120, and the through-hole H is filled with the magnetic material 11, such that overall magnetic permeability of the coil component 100 may be improved. A via hole 190 may be positioned at a position spaced apart from the through-hole H of the support member 120 by a predetermined interval. Since the inside of the via hole 190 is filled with a conductive material, the first coil pattern 131 and the second coil pattern 132 disposed on an upper surface and a lower surface of the support member 120 may be physically and electrically connected to each other via a via portion P.

Hereinafter, for convenience of explanation, the first coil pattern 131 will be described as a reference, and the contents thereof may be applied to the second coil pattern 132 as it is.

The first coil pattern 131 may form a plurality of windings. For example, the first coil pattern 131 may have a form wound in a spiral shape, and the number of windings may be appropriately selected depending on a design. The first coil pattern 131 may be formed by an electroplating process.

The first coil pattern 131 may be formed of a metal having excellent electrical conductivity. For example, the first coil pattern 131 may be formed of silver (Ag), palladium (Pd), aluminum (Al), nickel (Ni), titanium (Ti), gold (Au), copper (Cu), platinum (Pt), or alloys thereof, but is not necessarily limited thereto.

In addition, the coil part 13 may further include the pattern walls 151. In addition, the coil pattern 130 may extend between the pattern walls 151 on the support member 120. Direct current (DC) resistance Rdc characteristics, which are one of main characteristics of the coil component, for example, an inductor, may be reduced as a cross-sectional area of the coil is increased. In addition, an inductance may be increased as an area of a magnetic region in the body through which a magnetic flux passes is increased. Therefore, in order to decrease the DC resistance Rdc and increase the inductance, the cross-sectional area of the coil needs to be increased and the area of the magnetic region needs to be increased. As a method of increasing the cross-sectional area of the coil part, there are a method of increasing widths of the coil patterns and a method of increasing thicknesses of the coil patterns. However, in a case of simply increasing the width of the coil pattern, there is a risk that a short-circuit between the coil patterns will occur. In addition, a limitation is generated in the number of windings of coil patterns that may be implemented, which leads to decrease an area occupied by the magnetic region, such that efficiency is decreased and a limitation is also generated in implementing a high inductance product. On the other hand, in a case of implementing coil patterns having a high aspect ratio by increasing thicknesses of conductor patterns without increasing widths of the conductor patterns, the above-mentioned problems may be solved. According to the present disclosure, since the pattern walls 151 are utilized as plating growth guides to form the coil patterns, shapes of the coil patterns may be easily adjusted.

The pattern walls 151 may have a fine width (e.g., 12 μm or less) to maximally secure the widths of the coil patterns. In addition, the pattern walls 151 may have a height corresponding to an intended aspect ratio of the coil pattern to serve as the plating growth guides of the coil pattern. However, since the pattern walls 151 are in contact with the support member 120 supporting the pattern walls 151 with a fine width, lifting or voids may occur between the pattern walls 151 and the support member 120. The pattern walls 151 may be tilted or collapsed by unintended effects (e.g., Laplace pressure) before and after the plating process.

According to the present disclosure, since the trenches 125 are formed in the support member 120, and anchors of the pattern walls 151 fill the trenches 125 and remaining portions of the pattern walls 151 extend from the anchors thereof, respectively, the occurrence of the lifting or the voids between the pattern walls 151 and the support member 120 may be reduced, and the pattern walls 151 may be stably supported so as not to be tilted or collapsed.

The trenches 125 may be formed in the support member 120 by an etching process. The trenches 125 may be machined by, for example, an imprint method or a laser method (for example, a Neodymium-doped Yttrium Aluminum Garnet (Nd-YAG) laser, $CO_2$ laser, and ultra-violet (UV) excimer laser), which is not particularly limited as long as it is known in the technical field of the present disclosure.

Meanwhile, the upper surface of the first coil pattern 131 may be covered with a first insulating layer 171. Alternatively, as illustrated in FIG. 3, the first insulating layer 171 may entirely coat the first coil pattern 131. Such a first insulating layer 171 may have a function of insulating the first coil pattern 131 so that the first coil pattern 131 is not in contact with the magnetic material 11 filled in the body 10. In addition, a second insulating layer 172 coating the second coil pattern 132 may have the same function as that of the first insulating layer 171.

Figure 4:
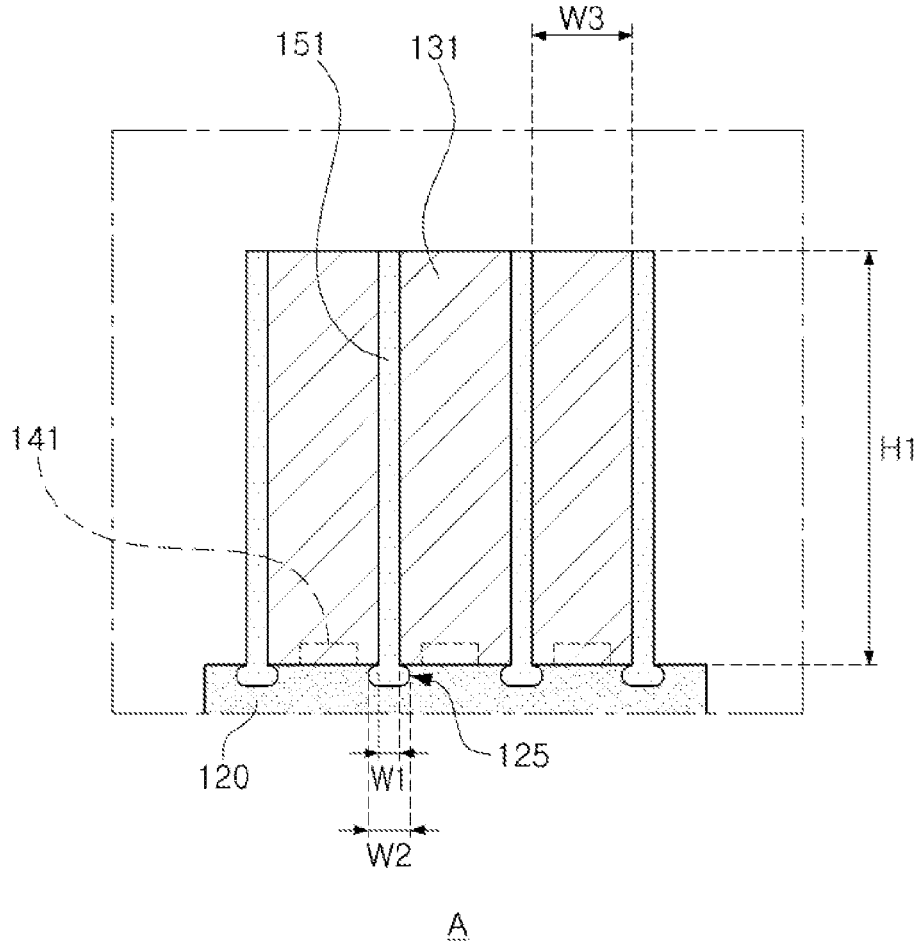
FIG. 4 illustrates a schematic enlarged view of region A of the coil component of FIG. 3.

FIG. 4 illustrates a schematic enlarged view of a region A of the coil component of FIG. 3. For convenience of explanation, the first insulating layer 171 is not illustrated.

In order to increase the cross-sectional area within a limited space, the first coil pattern 131 may have a shape in which a ratio of a height H1 to a width W3, that is, an aspect ratio is large. For example, a high aspect ratio that the coil pattern may have may be about 3 to 20.

The first coil pattern 131 may be formed by plating growth after the pattern walls 151 are formed. To this end, before forming the pattern walls 151, a plating seed 141 may be disposed on the support member 120. The plating seed 141 may be formed by an electroless plating process. After the pattern walls 151 having a partition shape are formed, the first coil pattern 131 may be formed using the plating seed 141 as a seed of a plating process. In order to have a high aspect ratio, the first coil pattern 131 may be formed by several plating processes, and in this case, the first coil pattern 131 may have a multilayer structure. The pattern wall 151 may be formed of a photosensitive resin in which one photo acid generator and several epoxy-based resins are combined, and one or more epoxies may be used.

In such a plating process, the pattern wall 151 having an anchor formed in the trench 125 may not be tilted and may be stably supported.

As illustrated in FIG. 4, a portion of the trench 125 of the pattern wall 151 having a width W2 wider than a width W1 of a portion of the trench 125 exposed to the upper surface of the support member 120 may be included in the support member 120. A material forming the pattern wall 151 may be filled in the trench 125 to form the anchor of the pattern wall 151. In addition, since bonding interfaces between the pattern wall 151 and the support member 120 are formed along wall of the trench 125, the pattern walls 151 may be more stably supported.

Figure 5:
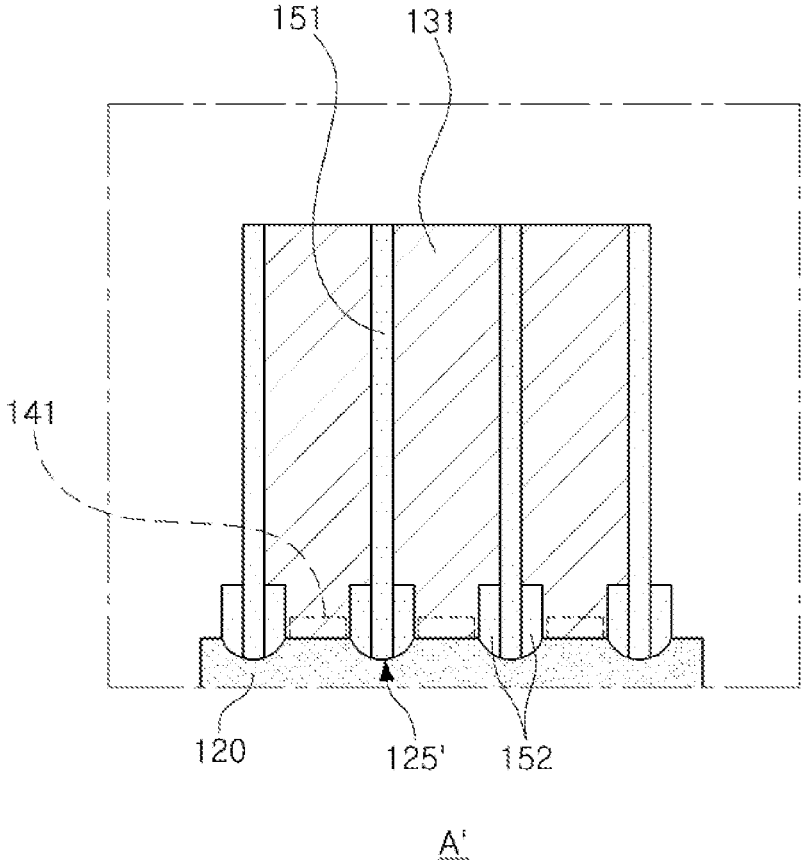
FIG. 5 illustrates another example of the schematic enlarged view of the region A of the coil component of FIG. 3.

FIG. 5 illustrates another example of the schematic enlarged view of the region A of the coil component of FIG. 3.

Unlike the trench 125 described with reference to FIG. 4, a width of a portion of the trench 125' of FIG. 5 exposed to the upper surface of the support member 120 may be wider than a width of a portion of the trench 125' inside of the support member 120. In addition, the coil part may include support walls 152 supporting the pattern wall 151 on at least one side of the pattern wall 151. As illustrated in FIG. 5, the support walls 152 may be formed on both sides of the pattern wall 151. In addition, the support walls 152 may be formed in the trench 125'. The support wall 152 may be formed of the same material as that of the pattern wall 151, but is not limited thereto.

FIGS. 6A through 6E illustrate an example of processes of manufacturing the coil component of FIG. 4. Specifically, FIGS. 6A through 6E illustrate an example of processes of forming the coil part 13 (FIG. 1) of the coil component. Hereinafter, the processes will be sequentially described with reference to the accompanying drawings.

Figure 6A:
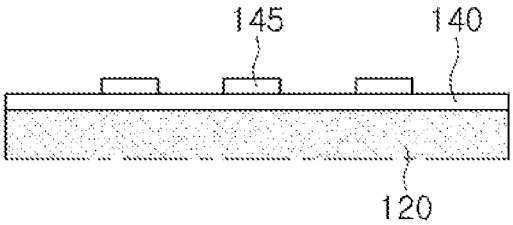
FIGS. 6A through 6E illustrate an example of processes of manufacturing the coil component of FIG. 4.

Referring to FIG. 6A, first, a support member 120 may be provided, and a plating seed layer 140 may be formed on at least one surface of the support member 120. The plating seed layer 140 may be formed by the known method, for example, chemical vapor deposition (CVD), physical vapor deposition (PVD), sputtering, or the like, using a dry film, or the like, but is not limited thereto. In addition, a mask pattern 145 for preventing etching may be disposed on the plating seed layer 140.

Figure 6B:
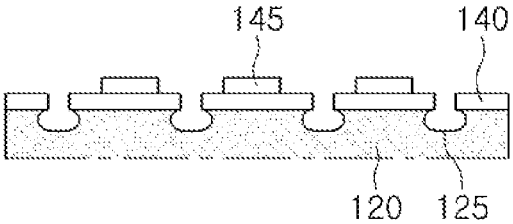

Referring to FIG. 6B, trenches 125 may be formed in the support member 120 through an etching process for trench machining. In a case in which the trench machining is performed in a state in which the plating seed layer 140 is formed on one surface of the support member 120, in the trenches 125, the inside of the support member may be etched more widely than the surface of the support member protected by the plating seed layer 140. Accordingly, each trench 125 may include a portion having a width greater than the width of the portion exposed to the surface of the support member 120, in the support member 120.

Figure 6C:
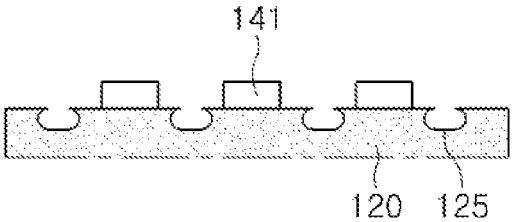

Referring to FIG. 6C, the plating seed layer 140 may be etched through an etching process. At this time, a plating seed 141 of the plating seed layer 140 below the mask pattern 145 may be left and the mask pattern 145 may be removed through an appropriate asking process or an etching process.

Figure 6D:
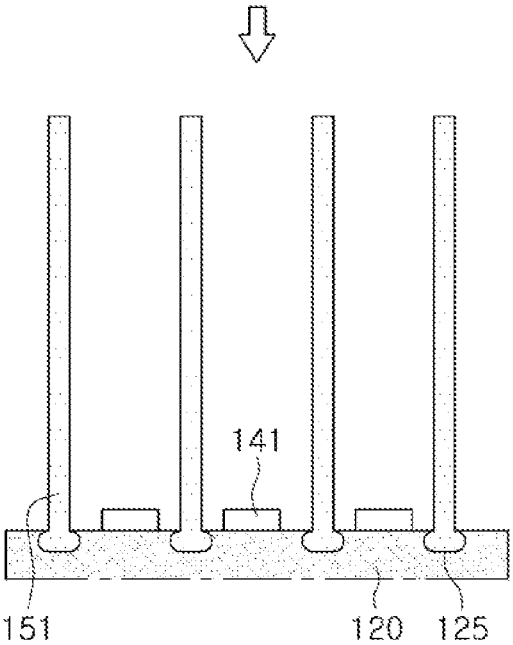

Referring to FIG. 6D, pattern walls 151 may be formed while filling the trenches 125.

Figure 6E:
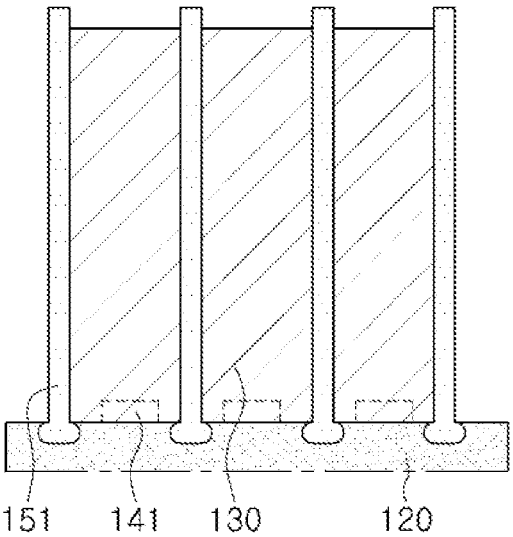

Referring to FIG. 6E, a coil pattern 130 extending between the pattern walls 151 on the support member may be formed using the plating seed 141. The coil pattern 130 may be formed by plating growth, and the pattern walls 151 may be utilized as plating growth guides.

Although not shown, a polishing process may be performed to planarize upper surfaces of the pattern walls 151 and the coil pattern 130.

FIGS. 7A through 7G illustrate an example of processes of manufacturing the coil component of FIG. 5. Specifically, FIGS. 7A through 7G illustrate another example of processes of forming the coil part 13 (FIG. 1) of the coil component. Hereinafter, the processes will be sequentially described with reference to the accompanying drawings.

Figure 7A:
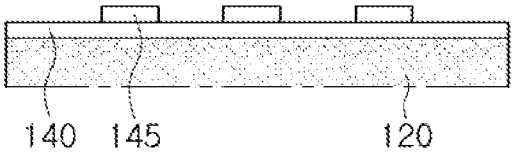
FIGS. 7A through 7G illustrate an example of processes of manufacturing the coil component of FIG. 5.

Referring to FIG. 7A, first, a support member 120 may be provided, and a plating seed layer 140 may be formed on at least one surface of the support member 120. As described in FIGS. 6A through 6E, the plating seed layer 140 may be formed by the known method. In addition, a mask pattern 145 for preventing etching may be disposed on the plating seed layer 140.

Figure 7B:
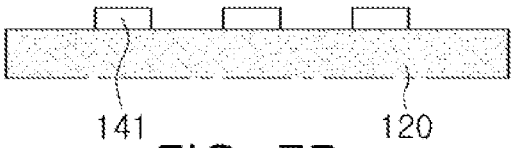

Referring to FIG. 7B, the plating seed layer 140 may be etched through an etching process. At this time, a plating seed 141 of the plating seed layer 140 below the mask pattern 145 may be left. In addition, the mask pattern 145 may be removed through an appropriate asking process or an etching process.

Figure 7C:
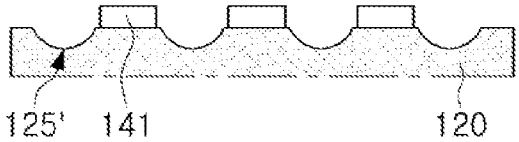

Referring to FIG. 7C, trenches 125' may be formed in the support member 120 through an etching process for trench machining.

Figure 7D:
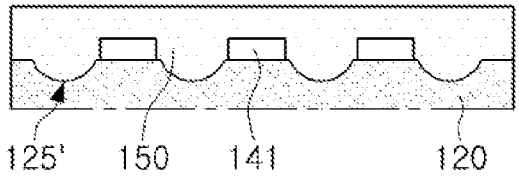

Referring to FIG. 7D, a support layer 150 may be applied on a surface of the support member 120 in which the trenches 125' are formed. The support layer 150 may be formed of a photosensitive resin and may be formed of the same material as pattern walls 151 to be described below, but is not limited thereto.

Figure 7E:
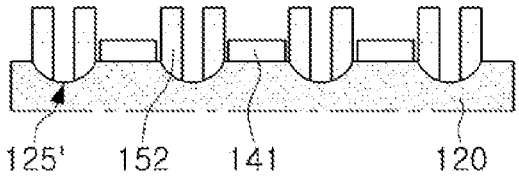

Referring to FIG. 7E, the support walls 152 may be formed through an exposure and development process. The support walls 152 may be formed in the trenches 125', and may be disposed to be adjacent to at least one side of a space in which the pattern walls 151 are formed.

Figure 7F:
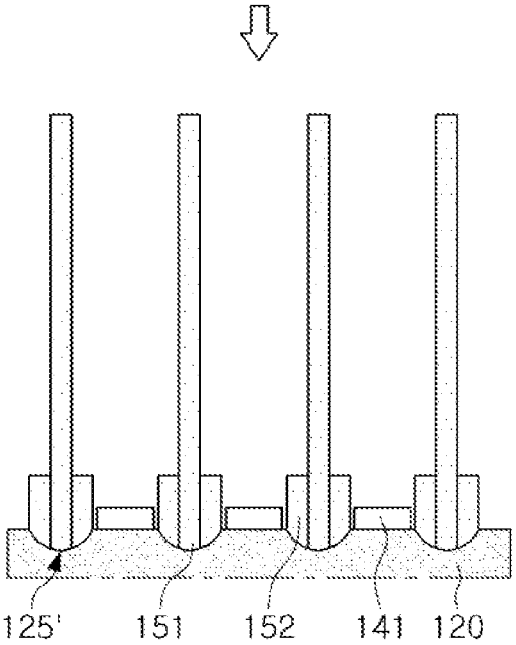

Referring to FIG. 7F, the pattern walls 151 may be formed in the trenches 125'. At least one side of the pattern wall 151 may be supported by the support walls 152.

Figure 7G:
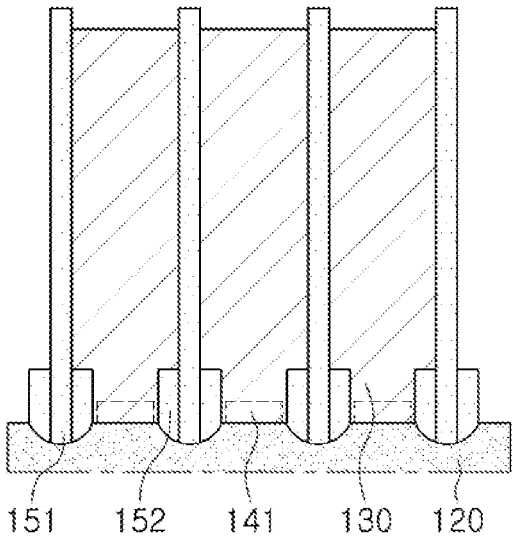

Referring to FIG. 7G, a coil pattern 130 extending between the pattern walls 151 on the support member may be formed using the plating seed 141. The coil pattern 130 may be formed by plating growth, and the pattern walls 151 may be utilized as plating growth guides.

Although not shown, a polishing process may be performed to planarize upper surfaces of the pattern walls 151 and the coil pattern 130.

In the present specification, "electrically connected" means the concept including a physical connection and a physical disconnection. It may be understood that when an element is referred to with "first" and "second", the element is not limited thereby. They may be used only for a purpose of distinguishing the element from the other elements, and may not limit the sequence or importance of the elements. In some cases, a first component may be named a second component and a second component may also be similarly named a first component, without departing from the scope of the present disclosure.

As set forth above, according to an exemplary embodiment in the present disclosure, since the coil component has the pattern walls between the coil patterns which are formed in the trench of the support member, an occurrence of lifting or voids between the pattern walls and the support member supporting the pattern walls may be reduced.

In addition, the pattern walls may be stably supported so as not to be tilted or collapsed.

Accordingly, the risk of a short-circuit failure and an electrical over stress (EOS) failure that may occur in the coil component may be eliminated.

Various advantages and effects of the present disclosure are not limited to the description above, and may be more readily understood in the description of exemplary embodiments in the present disclosure.

While exemplary embodiments have been shown and described above, it will be apparent to those skilled in the art that modifications and variations could be made without departing from the scope of the present invention as defined by the appended claims.

What is claimed is:

1. A coil component comprising:

a body in which a coil part is embedded, wherein the coil part includes:

a support member having trenches;

pattern walls extending from the trenches in the support member; and coil patterns extending between the pattern walls on the support member, the pattern walls include an innermost pattern wall extending from an innermost one of the trenches in the support member and an outermost pattern wall extending from an outermost one of the trenches in the support member, and an entirety of the coil patterns is disposed between the innermost pattern wall and the outermost pattern wall.

2. The coil component of claim 1, wherein a portion, spaced apart from a surface of the support member, of one of the trenches has a width wider than a width of another portion, exposed to the surface of the support member, of the one of the trenches.

3. The coil component of claim 1, wherein the pattern walls include anchor portions disposed in the trenches in the support member and remaining portions extending from the anchor portions, respectively, and the anchor portions and the remaining portions of the pattern walls are made of the same material.

4. The coil component of claim 1, further comprising support walls supporting the pattern walls disposed on at least one side of each of the pattern walls.

5. The coil component of claim 1, further comprising support walls supporting the pattern walls disposed on both sides of each of the pattern walls.

6. The coil component of claim 5, wherein the support walls also fill the trenches in the support member.

7. The coil component of claim 1, wherein the coil patterns include plating seed patterns disposed between the pattern walls on the support member and plating layers covering the seed patterns.

8. The coil component of claim 1, wherein the pattern walls are formed of a photosensitive resin.

9. The coil component of claim 1, wherein the support member includes a through-hole in the center of the coil part, and the through-hole is filled with a magnetic material.

10. The coil component of claim 1, wherein the pattern walls and the coil patterns are disposed on both surfaces of the support member opposing each other.

11. The coil component of claim 10, wherein the coil part includes a via hole connecting the coil patterns disposed on both surfaces of the support member to each other.

12. The coil component of claim 1, wherein the coil part further includes an insulating layer covering upper surfaces of the coil patterns.

13. A coil component comprising:

a body in which a coil part is embedded, wherein the coil part includes:

a support member having trenches;

pattern walls extending from the trenches in the support member; and coil patterns extending between the pattern walls on the support member, the pattern walls include anchor portions disposed in the trenches in the support member and remaining portions extending from the anchor portions, respectively, the trenches are filled with only the anchor portions of the pattern walls, the anchor portions and the remaining portions of the pattern walls are made of the same material, the pattern walls include an innermost pattern wall extending from an innermost one of the trenches in the support member and an outermost pattern wall extending from an outermost one of the trenches in the support member, and an entirety of the coil patterns is disposed between the innermost pattern wall and the outermost pattern wall.

14. The coil component of claim 13, wherein a portion, spaced apart from a surface of the support member, of one of the trenches has a width wider than a width of another portion, exposed to the surface of the support member, of the one of the trenches.

15. The coil component of claim 13, wherein the coil patterns include plating seed patterns disposed between the pattern walls on the support member and plating layers covering the seed patterns.

16. The coil component of claim 13, wherein the pattern walls are formed of a photosensitive resin.

17. A coil component comprising:

a body in which a coil part is embedded, wherein the coil part includes:

a support member having trenches recessed from a surface of the support member;

pattern walls extending from the trenches in the support member;

coil patterns extending between the pattern walls on the support member, and a portion, spaced apart from a surface of the support member, of one of the trenches has a width wider than a width of another portion, exposed to the surface of the support member, of the one of the trenches, the pattern walls include an innermost pattern wall extending from an innermost one of the trenches in the support member and an outermost pattern wall extending from an outermost one of the trenches in the support member, and an entirety of the coil patterns is disposed between the innermost pattern wall and the outermost pattern wall.

18. The coil component of claim 17, wherein the pattern walls include anchor portions disposed in the trenches in the support member and remaining portions extending from the anchor portions, respectively, and the anchor portions and the remaining portions of the pattern walls are made of the same material.

19. The coil component of claim 17, wherein the coil patterns include plating seed patterns disposed between the pattern walls on the support member and plating layers covering the seed patterns.

20. The coil component of claim 17, wherein the pattern walls are formed of a photosensitive resin.

* * * * *